US007007905B2

(12) United States Patent
Roberts

(10) Patent No.: US 7,007,905 B2
(45) Date of Patent: Mar. 7, 2006

(54) BRACKET WITH INTERCHANGEABLE ORNAMENTAL CROSS BRACE

(76) Inventor: Richard J. Roberts, 19778 West Chester, Clinton Township, MI (US) 48038

( * ) Notice: Subject to any disclaimer, the term of this patent is extended or adjusted under 35 U.S.C. 154(b) by 0 days.

(21) Appl. No.: 10/765,682

(22) Filed: Jan. 27, 2004

(65) Prior Publication Data

US 2005/0161569 A1 Jul. 28, 2005

(51) Int. Cl.
*E04G 3/08* (2006.01)

(52) U.S. Cl. ..... 248/250; 108/108; 248/903; 428/13; D8/381

(58) Field of Classification Search ..... 248/250, 248/235, 247, 309.1, 903; D8/381, 373; 428/13; 108/108
See application file for complete search history.

(56) References Cited

U.S. PATENT DOCUMENTS

| | | | | | |
|---|---|---|---|---|---|
| 104,463 | A | * | 6/1870 | Judd | 248/235 |
| 208,319 | A | * | 9/1878 | Jones | 248/235 |
| 541,114 | A | * | 6/1895 | Nolan | 248/235 |
| 883,323 | A | * | 3/1908 | Macduff | 248/250 |
| 4,049,226 | A | | 9/1977 | Harvey | |
| 4,702,176 | A | | 10/1987 | Goshow | |
| 4,805,863 | A | * | 2/1989 | Armstrong et al. | 248/243 |
| 4,856,746 | A | | 8/1989 | Wrobel | |
| 5,154,388 | A | | 10/1992 | Magaro | |
| 5,176,348 | A | | 1/1993 | Gale | |
| 5,183,232 | A | | 2/1993 | Gale | |
| 5,257,766 | A | * | 11/1993 | Riblet | 248/248 |
| 5,381,738 | A | * | 1/1995 | Meyer | 108/42 |
| D365,748 | S | * | 1/1996 | Hollinger | D8/381 |
| D371,507 | S | * | 7/1996 | Hollinger | D8/373 |
| 5,826,851 | A | * | 10/1998 | Arbisi | 248/466 |
| 5,893,470 | A | | 4/1999 | Peggs | |
| 6,053,465 | A | * | 4/2000 | Kluge | 248/235 |
| 6,303,195 | B1 | * | 10/2001 | Reynolds et al. | 428/13 |

* cited by examiner

*Primary Examiner*—Ramon O Ramirez
(74) *Attorney, Agent, or Firm*—Young & Basile, P.C.

(57) ABSTRACT

A bracket can include an angled member having a first elongate portion engageable with the vertically extending surface allowing the bracket to be supported from the surface, and second elongate portion engageable with a shelf to be supported. An elongate interchangeable cross brace extends between the first and second elongate portions of the angled member. The cross brace can include opposite longitudinal ends releasibly received within the opposing apertures formed in the angled member. The cross brace can include an ornamental appearance and/or indicia including one of a hook, a picture frame, a hollow container, a pumpkin, a football helmet, a soccer ball, a basketball, a baseball, a teddy bear, a baby shoe, a fishing lure, indicia relating to a holiday, a special occasion, a school logo, a team logo, or the like.

21 Claims, 6 Drawing Sheets

BRACKET WITH INTERCHANGEABLE ORNAMENTAL CROSS BRACE

FIELD OF THE INVENTION

The present invention relates to a bracket for supporting a shelf from a vertically extending surface, and more particularly, to an angle bracket with an interchangeable ornamental cross brace.

BACKGROUND OF THE INVENTION

Many known shelf supporting angle brackets are formed in one solid piece. Some brackets are designed to eliminate the need for a cross brace between the outer ends, while other brackets are designed with a fixed cross brace integrally formed with the outer ends. In either case, the known shelf supporting angle brackets provide a static unchangeable ornamental design and appearance. The known brackets require complete removal and replacement of the bracket when the surrounding environment is being redecorated. In addition, the known shelf-supporting angle brackets do not allow temporary changes in ornamental appearance while decorating the surrounding environment for holidays or special occasions.

SUMMARY OF THE INVENTION

It would be desirable in the present invention to provide a shelf-supporting angle bracket capable of presenting a variety of ornamental appearances to coincide with the surrounding decor and to allow temporary decoration for holidays and special occasions without requiring complete removal and replacement of the angle bracket member. The present invention includes a bracket for supporting a shelf from a vertically extending surface. An angled member is provided having a first elongate portion engageable with the vertically extending surface allowing the bracket to be supported from the surface, and a second elongate portion engageable with a shelf to be supported. The first elongate portion extends at an angle with respect to the second elongate portion. An elongate interchangeable cross brace extends between the first and second elongate portions. Each of the first and second elongate portions of the angled member can have an aperture formed therein for releasably receiving outer opposite longitudinal ends of the interchangeable cross brace. The interchangeable cross brace can include a receptacle located between the first and second longitudinal ends. The receptacle can define a picture frame, or a hollow receptacle of sufficient size to enclose at least one item relating to a special occasion or relating to sports paraphernalia. The interchangeable cross brace can also include ornamental indicia formed thereon relating to one of a holiday, a special occasion, a collegiate logo, or a professional team logo. The elongate interchangeable cross brace can also define a hook for supporting the hanging of another article. The interchangeable cross brace can have an ornamental appearance depicting one of a pumpkin, a football helmet, a soccer ball, a basketball, a baseball, a picture frame, a teddy bear, baby shoes, a container, or a fishing lure. The interchangeable cross brace can be assembled and disassembled with respect to the angled member to provide any desired ornamental appearance or indicia suitable for the surrounding decor or to temporarily decorate the bracket for a holiday or other special occasion.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
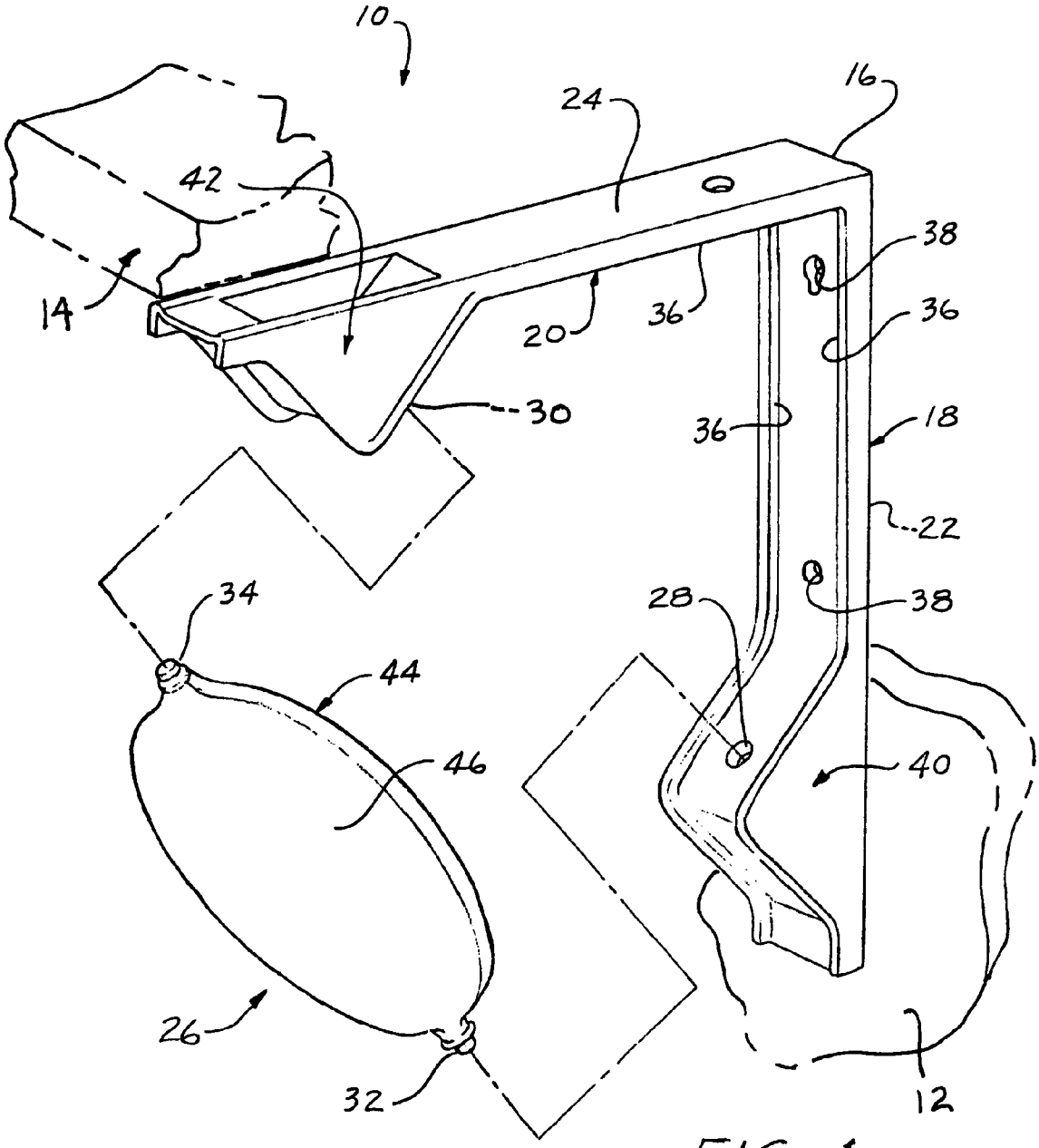
FIG. 1 is an exploded perspective view of a bracket according to the present invention for supporting a shelf from a vertically extending surface and including an elongate interchangeable cross brace.

Referring now to FIG. 1, a bracket 10 according to the present invention is shown in exploded perspective view. The bracket 10 is provided for supporting a shelf 12 from a vertically extending surface 14. The bracket 10 can include an angled member 16 having a first elongate portion 18 engageable with a vertically extending surface 14 allowing the bracket to be supported from the surface, and a second elongate portion 20 engageable with the shelf 12 to be supported. The first elongate portion 18 extends at an angle with respect to the second elongate portion 20. By way of example and not limitation, the angle can be approximately 90 degrees between a first surface 22 of the first elongate portion 18 engageable with the vertically extending surface 14 with respect to a second surface 24 of the second elongate portion 20 engageable with the shelf 12 to be supported. An elongate interchangeable cross brace 26 extends between the first and second elongate portions, 18 and 20 respectively.

Each of the first and second elongate portions 18, 20 can have an aperture 28, 30 respectively, formed therein for releasibly receiving opposite longitudinal ends 32, 34 of the interchangeable cross brace 26. The interchangeable cross brace 26 can be releasibly assembled to the angled member 16 in a self-locking fashion by bending the outer ends of the first and second elongate portions 18, 20 away from one another sufficiently to allow insertion of the opposite longitudinal ends 32, 34 of the cross brace 26 into the corresponding apertures 28, 30 formed in the first and second portions 18 and 20. Removal of the bending force from the angled member 16 allows the first and second portions 18 and 20 to resiliently return in a self-locking fashion to an original orientation releasibly holding complementary surfaces of the opposite longitudinal ends 32, 34 trapped within the apertures 28, 30 of the first and second portions 18 and 20. If desired, the angled member 16 can include stiffening ridges or ribs 36 in order to provide the desired rigidity, resiliency, and flexibility characteristics and/or if desired for ornamental decorative purposes. Fastener-receiving apertures 38 can be formed in one or both of the first and second elongate portions 18, 20 of the angled member 16 in order to secure the bracket 10 to the vertically extending wall surface 14 and/or to connect the bracket 10 to the shelf 12. Alternatively, the shelf can be held in place with respect to the bracket 10 by gravity, or by an outer upwardly extending tab engaging an outer peripheral edge of the shelf (not shown). The first and second elongate portions 18, 20 can include enlarged regions 40, 42 respectively adjacent the outer ends of the angled member 16. The enlarged regions 40, 42 can correspond to the location of the opposing apertures 28, 30 for receiving the opposite longitudinal ends 32, 34 of the interchangeable cross brace 26.

Figure 2:
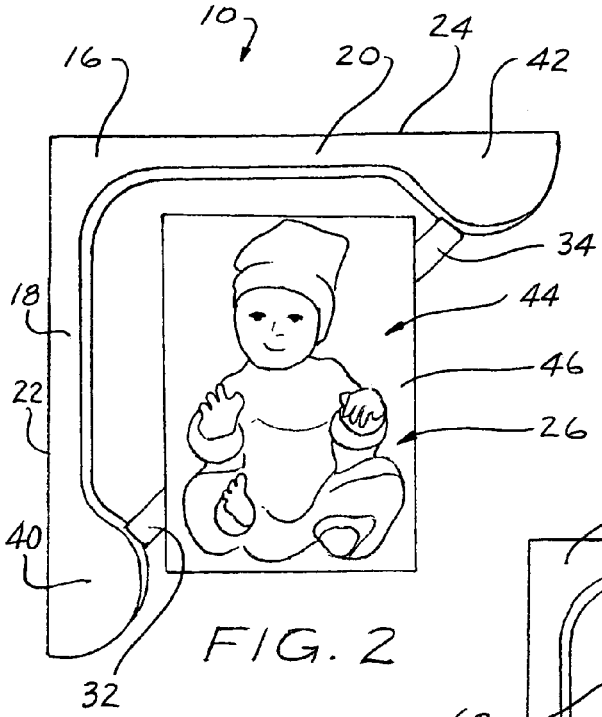
FIG. 2 is a side elevational view of a bracket according to the present invention with an elongate interchangeable cross brace including a receptacle located between first and second longitudinal ends of the cross brace.
Figure 6:
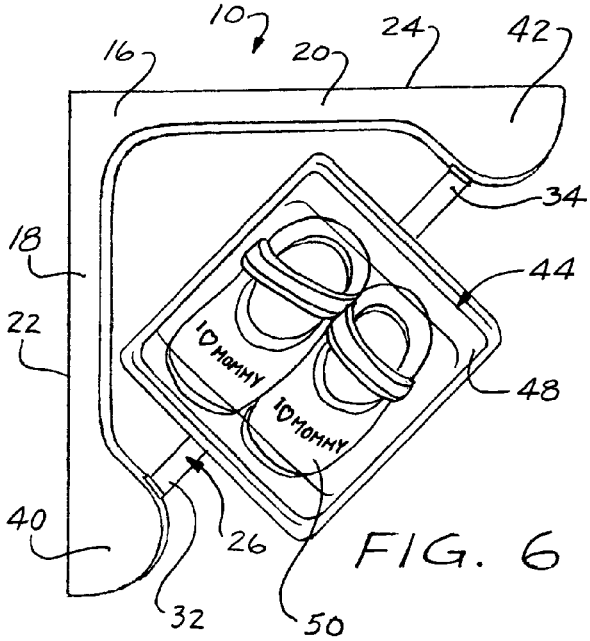
FIG. 6 is a side elevational view of a bracket according to the present invention with an elongate interchangeable cross brace including a hollow receptacle for receiving one of more items to be displayed, by way of example and not limitation, such as baby shoes having indicia spelling "I ♥ Mommy"

The cross brace 26 can include a receptacle 44 located between the first and second longitudinal ends 32, 34 as best seen in FIGS. 1 and 2, the receptacle 44 can define a picture frame 46. As best seen in FIGS. 6, the receptacle 44 can define a hollow box 48 of sufficient size to enclose at least 1 item relating to a special occasion. By way of example and not limitation, the hollow box 48 can enclose a pair of baby shoes 50. The hollow container 48 can also be of sufficient size and shape to enclose at least one item relating sports paraphernalia. By way of example and not limitation, the sports paraphernalia can include a golf ball, a baseball, a hockey puck, a tennis ball, a badminton birdie, or the like.

Figure 3:
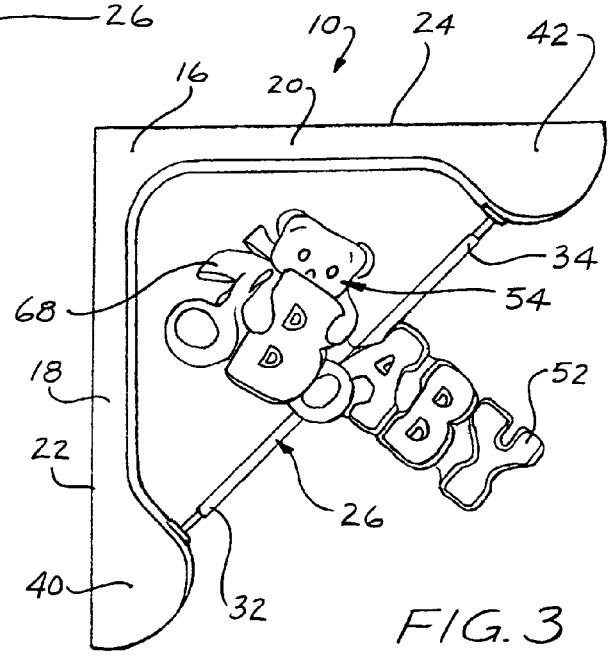
FIG. 3 is a side elevational view of a bracket according to the present invention with an elongate interchangeable cross brace including a teddy bear and indicia spelling "baby"
Figure 4:
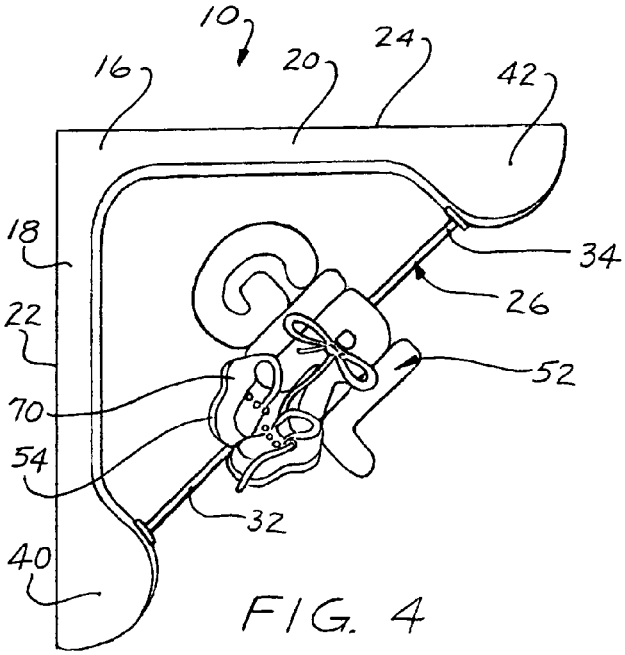
FIG. 4 is a side elevational view of a bracket according to the present invention with an elongate interchangeable cross brace including baby shoes and indicia spelling "girl"
Figure 5:
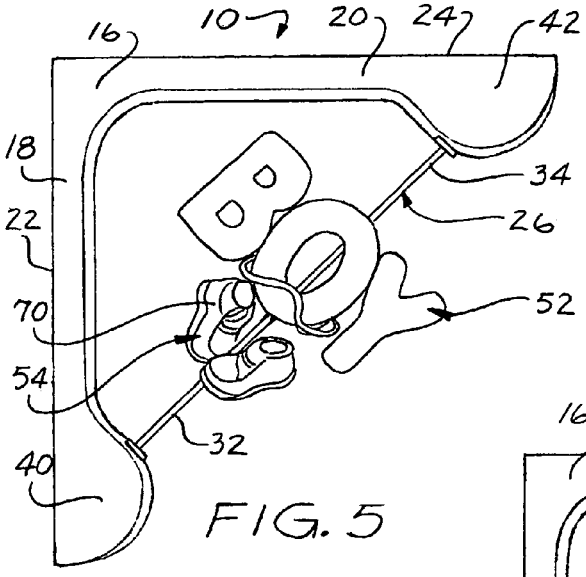
FIG. 5 is a side elevational view of a bracket according to the present invention with an elongate interchangeable cross brace including ornamentation of baby shoes and indicia spelling "boy"
Figure 7:
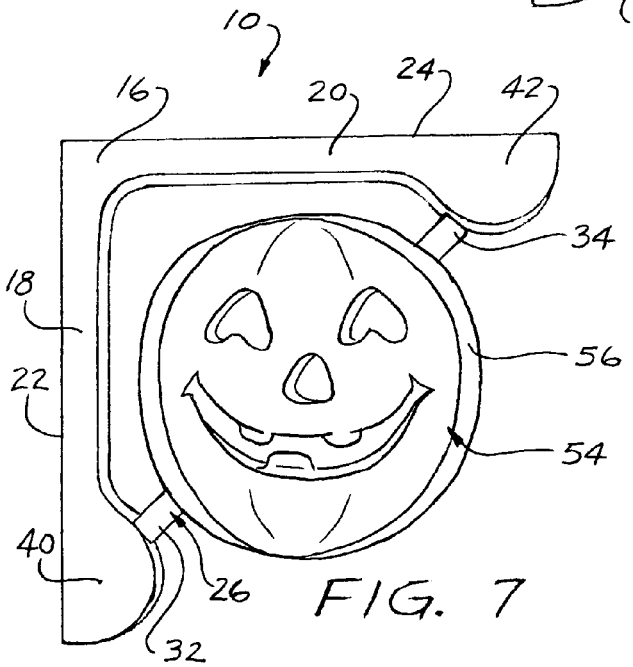
FIG. 7 is a side elevational view of a bracket according to the present invention including an elongate interchangeable cross brace depicting an ornamental appearance of a pumpkin.
Figure 8:
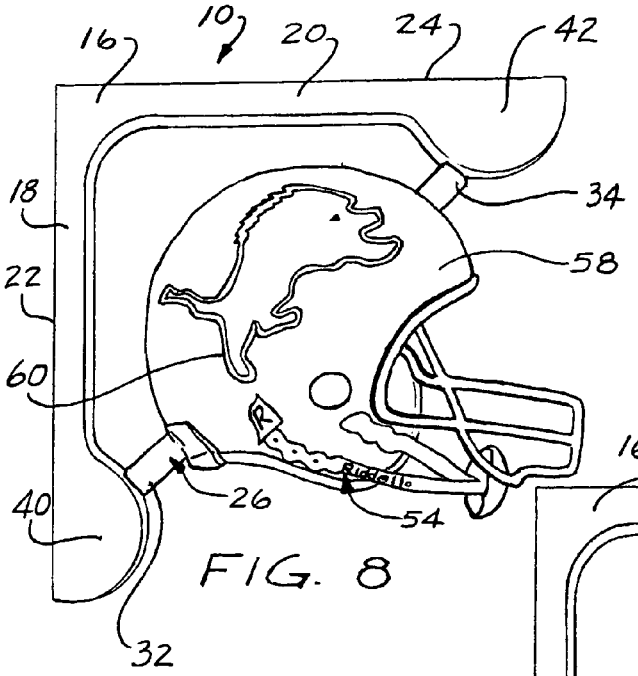
FIG. 8 is a side elevational view of a bracket according to the present invention including an elongate interchangeable cross brace with an ornamental appearance depicting a football helmet with a professional team logo.
Figure 9:
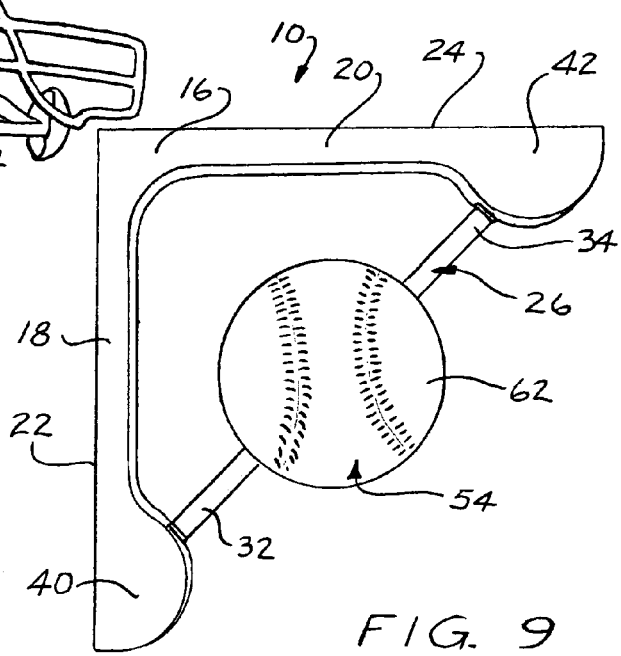
FIG. 9 is a side elevational view of a bracket according to the present invention including an interchangeable cross brace with an ornamental appearance depicting a baseball.
Figure 10:
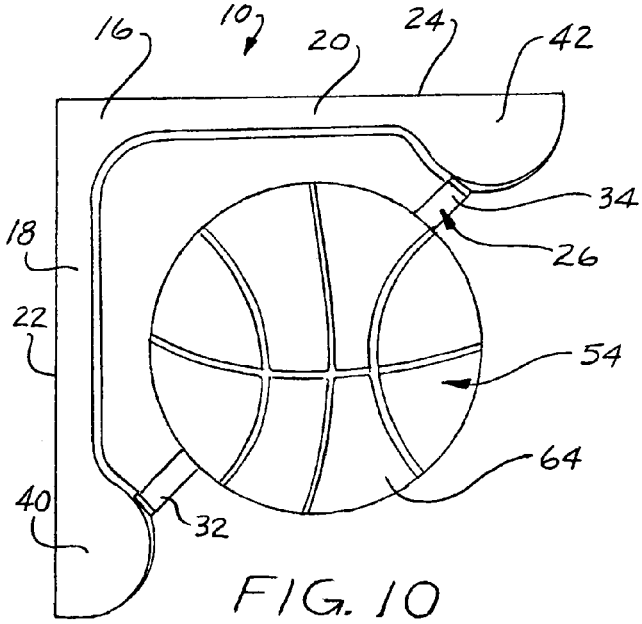
FIG. 10 is a side elevational view of a bracket according to the present invention including an elongate interchangeable cross brace with an ornamental appearance depicting a basketball.
Figure 11:
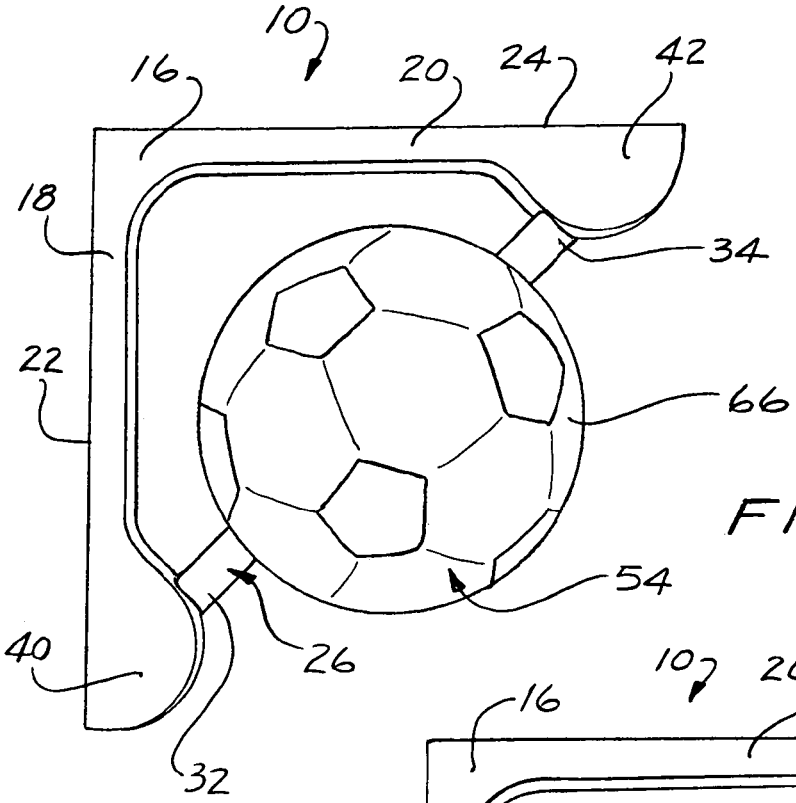
FIG. 11 is a side elevational view of a bracket according to the present invention including an elongate interchangeable cross brace with an ornamental appearance depicting an item related to sports paraphernalia, by way of example and not limitation, such as a soccer ball.
Figure 12:
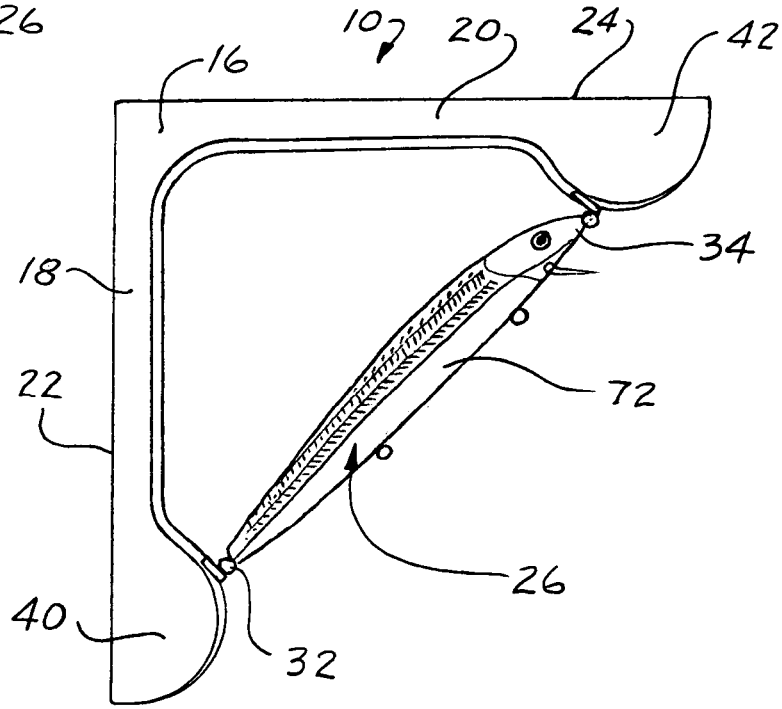
FIG. 12 is a side elevational view of a bracket according to the present invention including an elongate interchangeable cross brace with an ornamental appearance depicting a fishing lure.
Figure 13:
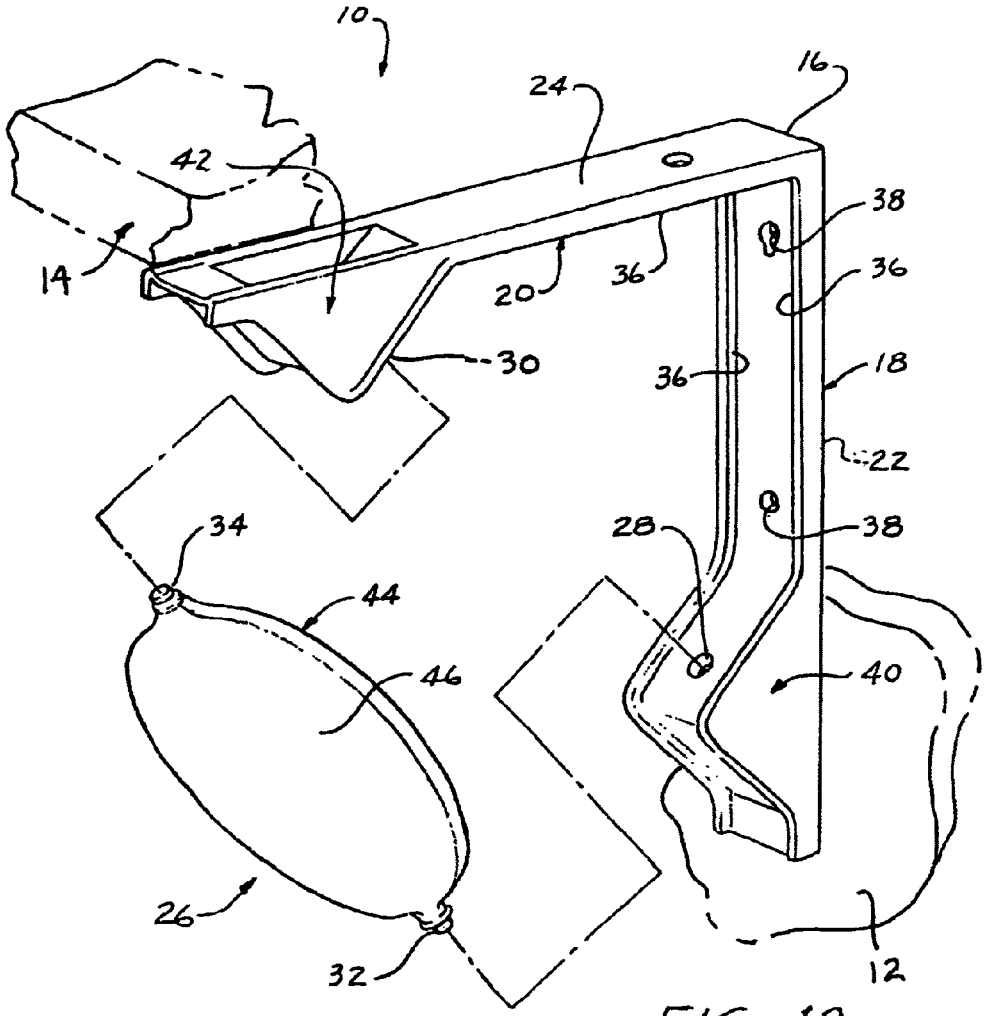
FIG. 13 is a side elevation view of an elongate interchangeable cross brace with an ornamental appearance depicting a hook for supportingly hanging another article.

The cross space 26 can include ornamental indicia formed thereon relating to one of a holiday, a special occasion, a collegiate logo, or a professional team logo. By way of example and not limitation, as best seen in FIG. 3, the ornamental indicia can include the letters spelling "Baby", "Girl", "Boy", or the like. By way of example and not limitation, the ornamental indicia for holidays can include "Merry Christmas", "Happy New Year", "Happy Chanukah", "Happy St. Patrick's Day", or the like. The ornamental indicia 52 can include any logo, by way of example and not limitation, high school logos, college logos, university logos, semi-professional team logos, professional team logos, or the like. The cross brace 26 can also include an ornamental appearance 54. By way of example and not limitation, the ornamental appearance can include a pumpkin 56 as illustrated in FIG. 7, a football helmet 58 as illustrated in FIG. 8 which can include a logo 60, a baseball 62 as illustrated in FIG. 9, a basketball 64 as illustrated in FIG. 10, a soccer ball 66 as illustrated in FIG. 11, a teddy bear 68 as illustrated in FIG. 3, baby shoes 70 as illustrated in FIG. 4 or FIG. 5, a container 44 as illustrated in FIG. 6, a picture frame 46 as illustrated in FIG. 1 or 2, or a fishing lure 72 as illustrated in FIG. 12. It should be recognized that other ornamental appearance 54 and/or ornamental indicia 52 can be used in the present invention. In addition, it should be recognized that the ornamental indicia 52 can be used alone, or in combination with the ornamental appearance 54, or the ornamental appearance 54 can be used alone according to the present invention. The present invention can also include a cross brace 26 defining a hook as illustrated in FIG. 13 for supportingly hanging another article. By way of example and not limitation, the hanging article can include a baseball cap, a banner, a pennant, or the like.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A bracket for supporting a shelf from a vertically extending surface comprising:

an angled member having a first elongate portion adapted to be engaged with a vertically extending surface allowing the angled member to be supported from the surface and a second elongate portion adapted to be engaged with a shelf to be supported, the first elongate portion extending at an angle with respect to the second elongate portion, enlarged portions integrally formed as one piece with the angled member adjacent each outer end of the first and second elongate portions of the angled member; and an elongate interchangeable cross brace engageable with the enlarged portions and extending between the first and second elongate portions.

2. The bracket of claim 1 further comprising:

each of the first and second elongate portions having an aperture formed therein for releasibly receiving the interchangeable cross brace.

3. The bracket of claim 1 further comprising:

the elongate interchangeable cross brace including ornamental indicia formed thereon relating to one of a holiday, a special occasions, a collegiate logo, and a professional team logo.

4. The bracket of claim 1 further comprising:

the elongate interchangeable cross brace defining a hook for supportingly hanging another article.

5. A bracket for supporting a shelf from a vertically extending surface comprising:

an angled member having a first elongate portion adapted to be engaged with a vertically extending surface allowing the angled member to be supported from the surface and a second elongate portion adapted to be engaged with a shelf to be supported, the first elongate portion extending at an angle with respect to the second elongate portion;

an elongate interchangeable cross brace extending between the first and second elongate portions, the elongate interchangeable cross brace having first and second longitudinal ends and a receptacle located between the first and second longitudinal ends; and self-interlocking complementary surfaces formed on each longitudinal end of the cross brace and each corresponding releasible attachment location of the first and second elongate portions of the angled member.

6. The bracket of claim 5 further comprising:

the receptacle defining a picture frame.

7. The bracket of claim 5 further comprising:

the receptacle defining a hollow box of sufficient size to enclose at least one item relating to a special occasion.

8. The bracket of claim 5 further comprising:

the receptacle defining a hollow container of sufficient size to enclose at least one item relating to sports paraphernalia.

9. A bracket for supporting a shelf from a vertically extending surface comprising:

an angled member having a first elongate portion adapted to be engaged with a vertically extending surface allowing the angled member to be supported from the surface and a second elongate portion adapted to be engaged with a shelf to be supported, the first elongate portion extending at an angle with respect to the second elongate portion, enlarged portions formed adjacent each outer end of the first and second elongate portions of the angled member; and an elongate interchangeable cross brace engageable with the enlarged portions and extending between the first and second elongate portions, the elongate interchangeable cross brace having an ornamental appearance depicting one of a pumpkin, a football helmet, a soccer ball, a basketball, a baseball, a picture frame, a teddy bear, baby shoes, a container, and a fishing lure.

10. A kit having a bracket for supporting a shelf from a vertically extending surface comprising:

an angled member having a first elongate portion adapted to be engaged with a vertically extending surface to be supported therefrom and a second elongate portion adapted to be engaged with a shelf to be supported, the first elongate portion extending at an angle with respect to the second elongate portion, each of the first and second elongate portions having an enlarged portion adjacent an outer end with opposing apertures formed therein; and a plurality of elongate interchangeable cross braces of different contoured surface ornamental appearances for interchangeably being engaged with respect to the angled member, each cross brace adapted to interchangeably extend between the first and second elongate portions when engaged within the opposing apertures formed in the enlarged portions of the angled member for releasibly receiving the interchangeable cross brace.

11. The bracket of claim 10 further comprising: one of the elongate interchangeable cross braces including ornamental indicia formed thereon relating to one of a holiday, a special occasions, a collegiate logo, and a professional team logo.

12. The bracket of claim 10 further comprising: one of the elongate interchangeable cross braces defining a hook for supportingly hanging another article.

13. A bracket for supporting a shelf from a vertically extending surface comprising:

an angled member having a first elongate portion adapted to be engaged with a vertically extending surface to be supported therefrom and a second elongate portion adapted to be engaged with a shelf to be supported, the first elongate portion extending at an angle with respect to the second elongate portion, each of the first and second elongate portions having an enlarged portion adjacent an outer end with opposing apertures formed therein; and an elongate interchangeable cross brace extending between the first and second elongate portions and engageable within the opposing apertures formed in the enlarged portions of the angled member for releasibly receiving the interchangeable cross brace, the elongate interchangeable cross brace having first and second longitudinal ends and a receptacle located between the first and second longitudinal ends.

14. The bracket of claim 13 further comprising:

the receptacle defining a picture frame.

15. The bracket of claim 13 further comprising:

the receptacle defining a hollow box of sufficient size to enclose at least one item relating to a special occasion.

16. The bracket of claim 13 further comprising:

the receptacle defining a hollow container of sufficient size to enclose at least one item relating to sports paraphernalia.

17. A bracket for supporting a shelf from a vertically extending surface comprising:

an angled member having a first elongate portion adapted to be engaged with a vertically extending surface to be supported therefrom and a second elongate portion adapted to be engaged with a shelf to be supported, the first elongate portion extending at an angle with respect to the second elongate portion, each of the first and second elongate portions having an enlarged portion adjacent an outer end with opposing apertures formed therein; and an elongate interchangeable cross brace extending between the first and second elongate portions and engageable within the opposing apertures formed in the enlarged portions of the angled member for releasibly receiving the interchangeable cross brace, the elongate interchangeable cross brace having an ornamental appearance consisting of a pumpkin, a football helmet, a soccer ball, a basketball, a baseball, a picture frame, a teddy bear, baby shoes, a container, and a fishing lure.

18. A kit having a bracket for supporting a shelf from a vertically extending surface comprising:

an angled member having a first elongate portion adapted to be engaged with a vertically extending surface to be supported therefrom and a second elongate portion adapted to be engaged with a shelf to be supported, the first elongate portion extending at an angle with respect to the second elongate portion, each of the first and second elongate portions having an enlarged portion adjacent an outer end with opposing apertures formed therein; and a plurality of elongate interchangeable cross braces of different contoured surface ornamental appearances for interchangeably being engaged with respect to the angled member, each cross brace adapted to interchangeably extend between the first and second elongate portions when engaged within the opposing apertures formed in the enlarged portions of the angled member for releasibly receiving the interchangeable cross brace, the elongate interchangeable cross brace having an ornamental appearance including one of a hook, a picture frame, a hollow container, a pumpkin, a football helmet, a soccer ball, a basketball, a baseball, a teddy bear, a baby shoe, a container, a fishing lure, a holiday indicia, a special occasion indicia, a collegiate logo indicia, and a professional team logo indicia.

19. A bracket for supporting a shelf from a vertically extending surface comprising:

an angled member having a first elongate portion adapted to be engaged with a vertically extending surface allowing the angled member to be supported from the surface and a second elongate portion adapted to be engaged with a shelf to be supported, the first elongate portion extending at an angle with respect to the second elongate portion;

an elongate interchangeable cross brace extending between the first and second elongate portions; and self-interlocking complementary surfaces formed on each longitudinal end of the cross brace and each corresponding releasible attachment location of the first and second elongate portions of the angled member.

20. The bracket of claim 19 further comprising:

an enlarged portion adjacent each outer end of the first and second elongate portions of the angled member corresponding to the attachment locations for the cross brace.

21. A bracket for supporting a shelf from a vertically extending surface comprising:

an angled member having a first elongate portion adapted to be engaged with a vertically extending surface allowing the angled member to be supported from the surface and a second elongate portion adapted to be engaged with a shelf to be supported, the first elongate portion extending at an angle with respect to the second elongate portion, enlarged portions integrally formed as one piece with the angled member adjacent each outer end of the first and second elongate portions of the angled member; and at least one elongate cross brace adapted to be engaged with and extend between the enlarged portions of the first and second elongate portions of the angled member.

* * * * *